United States Patent [19]

Cleveland

[11] 4,435,098

[45] Mar. 6, 1984

[54] OFFICE MACHINE ESCAPEMENT DISENGAGEMENT AND AUTOMATIC ENGAGEMENT MECHANISM

[75] Inventor: William E. Cleveland, Homer, N.Y.

[73] Assignee: SCM Corporation, New York, N.Y.

[21] Appl. No.: 360,156

[22] Filed: Mar. 22, 1982

[51] Int. Cl.[3] ..... B41J 29/56

[52] U.S. Cl. ..... 400/674; 400/685; 400/334

[58] Field of Search ..... 400/674, 675, 685, 334

[56] References Cited

U.S. PATENT DOCUMENTS

| | | | |
|---|---|---|---|
| 1,715,428 | 6/1929 | Rose | 400/674 X |
| 1,820,542 | 8/1931 | Phelps | 400/685 X |
| 1,854,134 | 4/1932 | Graepel | 400/674 |
| 2,675,115 | 4/1954 | Jones | 400/674 |
| 3,847,264 | 11/1974 | Harmon et al. | 400/674 X |

*Primary Examiner*—Ernest T. Wright, Jr.

*Attorney, Agent, or Firm*—Kenneth W. Greb; Ernest F. Weinberger

[57] ABSTRACT

An improved typewriter escapement disengagement and engagement mechanism wherein a separator member disengages the escapement mechanism from the carriage rack to prevent damage to the mechanism and/or rack during transport of the typewriter. A restraining means prevents the carriage from moving while the escapement mechanism is disengaged. When the restraining means is removed causing carriage movement, the separator member is automatically removed from between the escapement mechanism and the carriage rack and the escapement mechanism is engaged.

4 Claims, 4 Drawing Figures

A
2
3
4
5
6
7
8
9
9
10
12
14
16
18
20
23
24
26
30
32
34
36
38
40

A
2
4
9
9
3
7
6
8
5
10
26
40
16
14
18
38
36
24
23
34
32
30
20

OFFICE MACHINE ESCAPEMENT DISENGAGEMENT AND AUTOMATIC ENGAGEMENT MECHANISM

BACKGROUND OF THE INVENTION

1. Field of the Invention

The present invention is used in the field of office machines such as typewriters and similar machines, wherein an escapement mechanism cooperates with a carriage rack to permit the incremental advancement of the carriage. Means are provided for disengaging the escapement mechanism from the carriage rack to prevent damage to the mechanism and/or rack during certain conditions such as transport of the typewriter, and for automatically engaging the escapement mechanism with the carriage rack when carriage restraining means are removed from the typewriter.

2. Description of the Prior Art

Relevant prior art includes the typewriter escapement disengagement and escapement mechanism illustrated in FIG. 4 of the drawing and described more fully hereafter. A typewriter escapement disengagement and engagement mechanism substantially similar to that disclosed in FIG. 4 of the drawing is used in a typewriter sold by SCM Corporation under the trademark, "Sterling". The principal distinction between the mechanism shown in FIG. 4 and the present invention is that the prior art engagement mechanism shown in FIG. 4 requires a manual operation to cause the engagement of the escapement mechanism with the carriage rack when the carriage restraining means is removed, whereas the subject typewriter escapement disengagement and engagement mechanism includes means whereby the escapement is automatically engaged when the carriage restraining means is removed.

U.S. Pat. No. 1,715,428 to Rose discloses a mechanism whereby the escapement mechanism is disengaged from the carriage rack during transport of the typewriter, and thereafter automatically engaged with the carriage rack when the carriage restraining means, i.e. the typewriter carrying case covers, is lifted. However, the mechanism disclosed in the Rose patent for achieving this function differs substantially from the mechanism which is the subject matter of the present invention.

SUMMARY OF THE INVENTION

A separator member is placed between an escapement mechanism and carriage rack to disengage the escapement and carriage when, for example, the typewriter is being shipped. The disengaged carriage which would otherwise be caused to move by a spring means is maintained in position by a restraining means such as a bag. When the restraining means is removed from the disengaged carriage so that the spring means causes the carriage to move, the separator member is automatically ejected from between the escapement mechanism and carriage rack causing the escapement mechanism and carriage rack to be engaged.

DESCRIPTION OF THE PREFERRED EMBODIMENT

Figure 1:
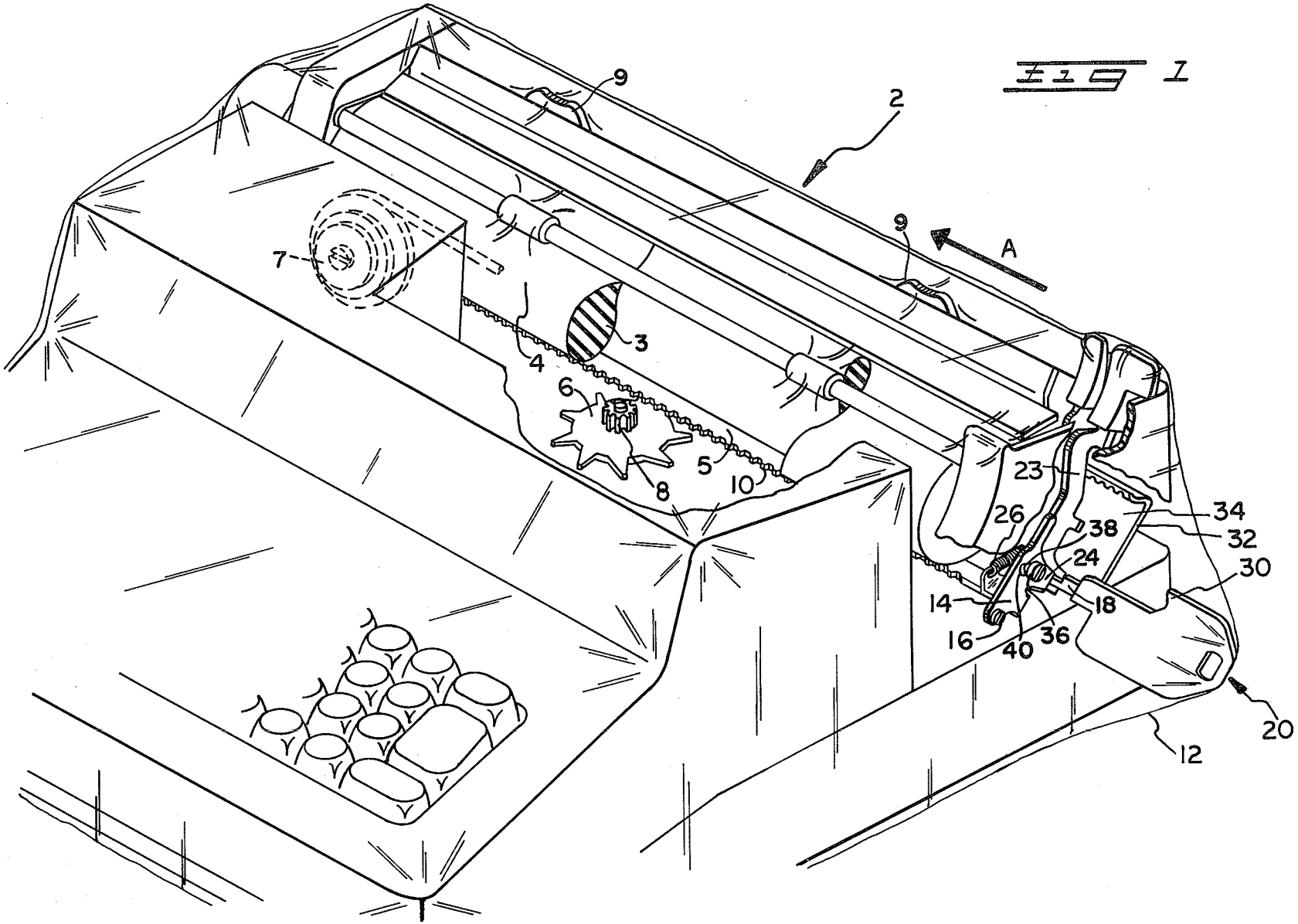
FIG. 1 is a partial isometric view of a typewriter, portions being broken away to show the typewriter escapement in its disengaged position and to show the carriage restraining means preventing carriage movement.

A typewriter 2 shown in FIG. 1 includes a carriage 4 which carries the platen 3 on which typing is to occur. The typewriter carriage 4 is biased by a spring mechanism 7 to move in the direction of arrow A and an escapement mechanism 6 enables the incremental advancement of the carriage 4 in the direction of arrow A. Escapement mechanism 6 operates in the following manner. When pinion teeth 8 of escapement mechanism 6 are in engagement with carriage rack 5 of carriage 4, the spring biased movement of carriage 4 in the direction of arrow A is prevented. Upon release of teeth 8 of escapement mechanism 6 from carriage rack 5, for example, by actuating a carriage release lever 23, carriage 4 moves in the direction of arrow A, until carriage movement is prevented by stops 9, such as margin stops 9, from further movement in the direction of arrow A.

It is desirable to provide for the disengagement of teeth 8 of escapement mechanism 6 from notches 10 of carriage rack 5 under certain circumstances, such as, for example, when the typewriter 2 is being transported by a carrier. Otherwise, should the typewriter 2 receive a sudden jolt when the teeth 8 of escapement mechanism 6 and the notches 10 of carriage rack 5 are engaged, the teeth 8 and/or notches 10 may fracture or break. When, as hereinafter described, the teeth 8 of escapement mechanism 6 are disengaged from notches 10 of carriage rack 5 as during shipping, a carriage restraining means such as a bag 12, is provided which surrounds typewriter 2 and prevents movement of the spring-biased carriage 4 in the direction of arrow A. The bag, 12, also protects the typewriter 2 from accumulating dust during storage and shipment.

To disengage the teeth 8 of escapement mechanism 6 from notches 10 of carriage rack 5, an arm 14 connected to carriage rack 5 is pivoted counter-clockwise about a pin 16. As arm 14 pivots counterclockwise about pin 16, notches 10 of carriage rack 5 connected to arm 14 are pivoted counter-clockwise out of engagement with teeth 8 of escapement mechanism 6.

Figure 3:
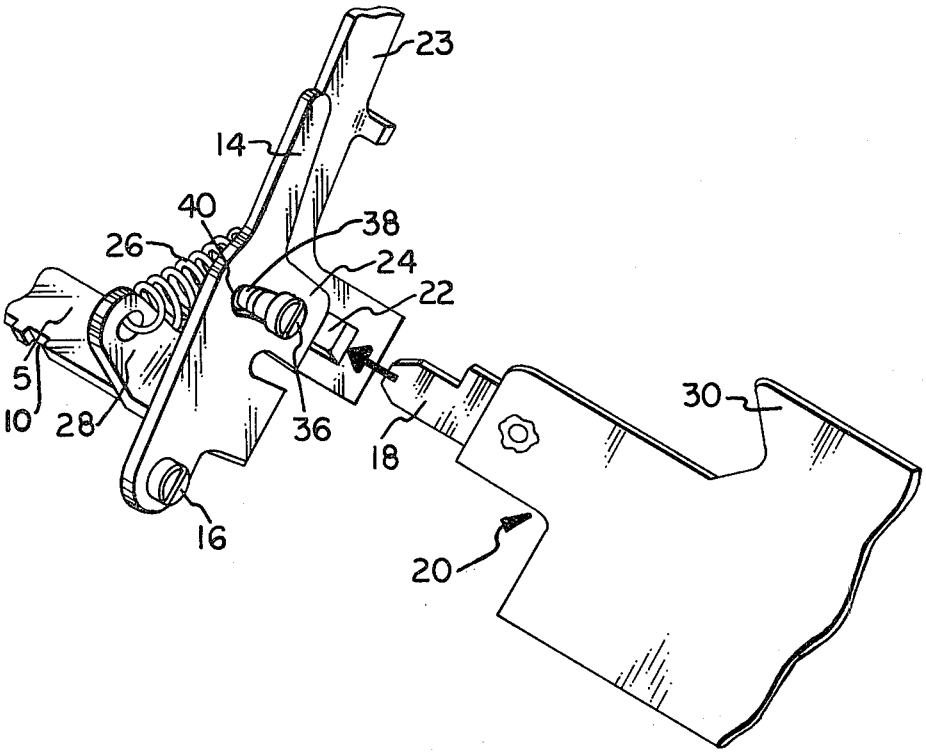
FIG. 3 is an isometric view of the typewriter escapement engagement mechanism showing the separator member aligned for placement on the carriage, and, FIG. 4 is an isometric view of the typewriter escapement engagement mechanism showing a prior art embodiment of a separator member.

To maintain notches 10 of carriage rack 5 out of engagement with teeth 8 of escapement mechanism 6, as best seen in FIG. 3, a finger 18 of separator member 20 which may be, for example, a shipping tag, is inserted between an opening 22 in a carriage release lever 23 and an abutment 24 in arm 14. In this manner arm 14 and connected carriage rack 5 are maintained in the position to which they had been pivoted, i.e. out of engagement with the teeth 8 of escapement mechanism 6.

A spring 26 connected at one end to extension 28 of carriage rack 5 is connected at its other end to carriage release lever 23 in such a manner that arm 14 is biased clockwise about pin 16 causing abutment 24 of arm 14 to be biased clockwise against finger 18 of separator member 20. In this manner abutment 24 of arm 14 secures finger 18 of separator member 20 in opening 22 of carriage release lever 23.

When separator member 20 is removed from between the opening 22 in carriage release lever 23 and abutment 24 on arm 14, spring 26 pivots carriage rack 5 clockwise causing notches 10 of carriage rack 5 to become engaged with teeth 8 of escapement mechanism 6. As previously mentioned, engagement of notches 10 of carriage rack 5 with teeth 8 of escapement mechanism 6 prevents movement of carriage 4 in the direction of arrow A. Accordingly, it will be seen that when separator member 20 is removed from between the opening 22 in carriage release lever 23 and abutment 24 on arm 14, the escapement mechanism 6 prevents movement of carriage 4 in the direction of arrow A.

According to the present invention, separator member 20 is automatically ejected from between the opening 22 in carriage release lever 23 and abutment 24 on arm 14 whenever the means, such as bag, 12, which prevents movement of the spring biased carriage 4 in the direction of arrow A is removed. Accordingly, whenever carriage 4 is disengaged from the escapement mechanism 6 and is free to move in the direction of arrow A, (i.e. notches 10 of carriage rack 5 having been pivoted out of engagement with teeth 8 of escapement mechanism 6) the separator member 20 is automatically ejected and notches 10 of carriage rack 5 are pivoted into engagement with teeth 8 of escapement mechanism 6 whereby carriage 4 is prevented from further movement in the direction of arrow A.

Figure 2:
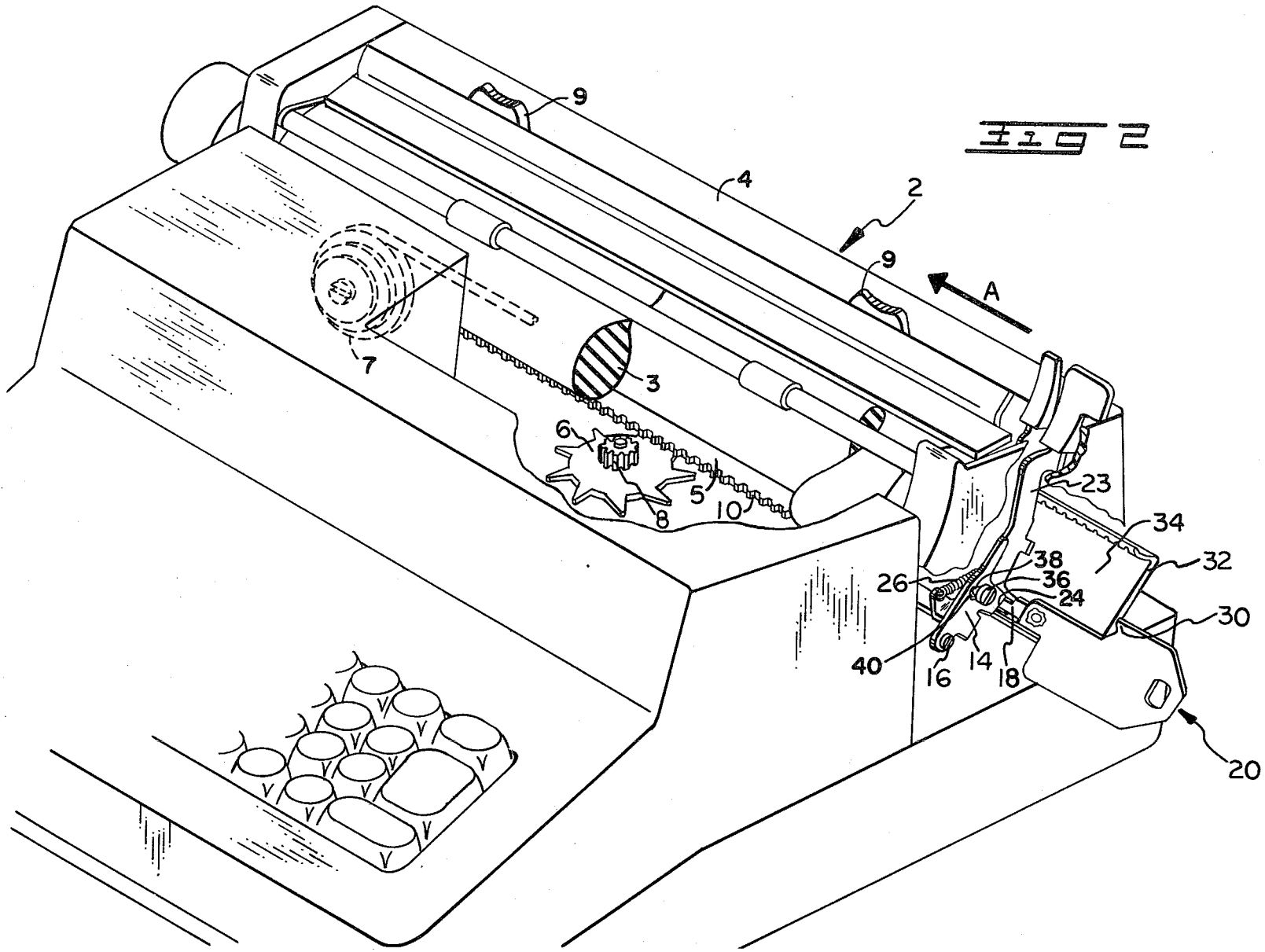
FIG. 2 is a partial isometric view of a typewriter, similar to FIG. 1 showing the carriage restraining means removed from the typewriter.

The means for automatically ejecting separator member 20 from between the opening 22 in carriage release lever 23 and abutment 24 on arm 14 include an ear 30 on separator member 20. When the notches 10 of carriage rack 5 are pivoted out of engagement with teeth 8 of escapement mechanism 6, and carriage 4 is able to move freely in the direction of arrow A, the ear 30 on separator member 20 contacts an edge 32 of carriage plate 34 as shown in FIG. 2, and edge 32 prevents further movement of separator member 20 in the direction of arrow A. As carriage 4, including arm 14 and carriage release lever 23, continues to move in the direction of arrow A, separator member 20 is prevented from so moving by its abutment with edge 32 of carriage plate 34, and separator member 20 is caused to be ejected from between carriage release lever 23 and arm 14.

To disengage the teeth 8 of escapement mechanism 6 from the notches 10 of carriage rack 5 for a purpose other than insertion of separator member 20, a carriage release lever 23 is pivoted counter-clockwise causing shouldered screw 36 attached to carriage release lever 23 to travel in groove 38 of arm 14. When shoulder screw 36 moves against surface 40 of groove 38, arm 14 pivots counter-clockwise about pin 16 and the nothces 10 of carriage rack 5 are disengaged from the teeth 8 of escapement mechanism 6. In this manner carriage release lever 23 causes the disengagement of the escapement mechanism 6 and carriage rack 5.

DESCRIPTION OF A PRIOR ART ESCAPEMENT MECHANISM

Figure 4:
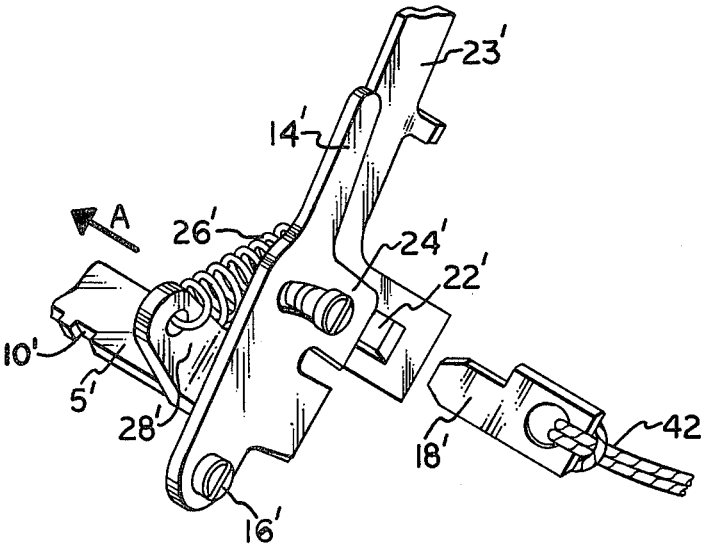
FIG 4 PRIOR ART

The prior art typewriter escapement mechanism shown in FIG. 4 is similar to the prior art typewriter mechanism shown in FIGS. 1 to 3, with the exception that the illustrated prior art typewriter mechanism does not include means whereby the separator member 18' is automatically ejected from between the carriage release lever 23' and the arm 14' whenever the carriage restraining means, such as bag, 12, is removed. In such a prior art typewriter escapement mechanism, as described hereafter, the separator member 18' is required to be manually removed from between the carriage release lever 23' and the arm 14'.

For comparison purposes, the prior art typewriter escapement mechanism illustrated in FIG. 4 will be identified by prime numbers corresponding to the numbers used in describing corresponding parts in the typewriter escapement mechanism illustrated in FIG. 3.

In the prior art escapement mechanism, illustrated in FIG. 4, to maintain the notches 10' of the carriage rack 5' out of engagement with the teeth 8 of the escapement mechanism 6 a separator member 18' which may be, for example, attached to a cord 42, is inserted between an opening 22' in carriage release lever 23' and an abutment 24' on arm 14'. In this manner, arm 14' and connected carriage rack 5' are maintained out of engagement with the teeth 8 of escapement mechanism 6.

Spring 26' connected at one end to extension 28' of carriage rack 5' is connected at its other end to carriage release lever 23' in such a manner that arm 14' is biased clockwise about pin 16' causing abutment 24' of arm 14' to be biased clockwise against separator member 18'. In this manner abutment 24' of arm 14' secures separator member 18' in opening 22' of carriage release lever 23'.

When separator means 18' is removed from between the opening 22' in carriage release lever 23' and abutment 24' on arm 14', spring 26' pivots carriage rack 5' clockwise causing the notches 10' of carriage rack 5' to become engaged with the teeth 8 of the escapement mechanism 6. Engagement of the notches 10' of the carriage rack 5' with the teeth 8 of the escapement mechanism 6 prevents movement of the carriage 4 in the direction of arrow A. Accordingly, when separator member 18' is removed from between the opening 22' in carriage release lever 23' and abutment 24' on arm 14', the escapement mechanism 6 prevents movement of carriage 4 in the direction of arrow A. Unlike the automatic separator ejecting means of the present invention, in order to remove separator member 18', it is necessary to manually remove the separator member 18' either by pulling separator member 18' directly, or pulling, for example, the cord 42 attached to separator member 18'.

It will be noted that in the prior art escapement mechanism illustrated in FIG. 4, when the carriage restraining means, such as bag 12, illustrated in FIG. 1, is removed, the disengaged carriage 4 will move in the direction of arrow A, and will continue to do so until separator member 18' is manually removed. And, in the event the separator member 18' is not promptly removed, the carriage 4 will move to the carriage return position upon removal of the restraining means. In contrast, according to the present invention when the carriage restraining means is removed and the carriage 4 begins to move in the direction of arrow A, the separator member 18 will automatically be ejected causing engagement of the escapement mechanism 6 and termination of carriage movement.

Variations and modifications including but not limited to those discussed above will occur to those skilled in the art once they are made aware of the basic concepts of the invention. Therefore, it is intended that the claims shall be construed to include not only the embodiments expressly described above, but all other variations and modifications as fall within the true spirit and scope of the invention.

Having thus described my invention, what I claim as new, and desire to secure by Letters Patent is:

1. A mechanism for disengaging and engaging an escapement mechanism for use in office machines such as typewriters and the like wherein the escapement mechanism selectively engages a carriage rack of a movable carriage to enable incremental carriage advancement, the disengaging and engaging mechanism comprising:

a pivotal arm connected to the carriage rack for causing pivotal movement of the carriage rack therewith;

a carriage release lever connected to the carriage rack by a spring means for maintaining the carriage rack in engagement with the escapement mechanism, said carriage release lever having an opening therein;

separator means insertable between the opening in the carriage release lever and the pivotal arm for pivoting the arm and causing pivotal movement of the carriage rack therewith out of engagement with the escapement mechanism; and, means including the separator means abutting a portion of the typewriter in response to carriage advancement for automatically ejecting the separator means from between the opening in the carriage release lever and the pivotal arm, whereby the spring means connected to the carriage release lever causes the carriage rack to be pivoted into engagement with the escapement mechanism.

2. The disengaging and engaging mechanism as set forth in claim 1 wherein the automatically ejecting means includes an ear on the separator means which abuts the portion of the typewriter upon carriage movement so that the separator means is thereby prevented from continued movement with the carriage release lever and pivotal arm.

3. The disengaging and engaging mechanism as set forth in claim 2 wherein the portion of the typewriter which the ear on the separator means abuts during carriage movement is a carriage plate.

4. The disengaging and engaging mechanism as set forth in claim 1 wherein the separator means is a shipping tag.

* * * * *